US005877788A

United States Patent [19]

Haan et al.

[11] Patent Number: 5,877,788

[45] Date of Patent: Mar. 2, 1999

[54] CLEANING FLUID APPARATUS AND METHOD FOR CONTINUOUS PRINTING INK-JET NOZZLE

[75] Inventors: Henk Haan; Roger J. Rowland, both of Niagara Falls; Anthony V. Moscato, North Tonawanda; Kenneth C. Chapin; Michael A. Graziano, both of Grand Island; Paul J. Paroff, E. Amherst, all of N.Y.

[73] Assignee: Moore Business Forms, Inc., Grand Island, N.Y.

[21] Appl. No.: 437,926

[22] Filed: May 9, 1995

[51] Int. Cl.[6] ..... B41J 2/015; B41J 2/165

[52] U.S. Cl. ..... 347/28; 347/21; 347/22

[58] Field of Search ..... 347/28, 29, 34, 347/30, 25, 21, 22; 342/21, 22, 28, 29

[56] References Cited

U.S. PATENT DOCUMENTS

| | | | |
|---|---|---|---|
| 3,854,399 | 12/1974 | Keur et al. . | |
| 3,981,020 | 9/1976 | Takano et al. . | |
| 4,024,548 | 5/1977 | Alonso et al. . | |
| 4,031,561 | 6/1977 | Paranjpe | 347/28 |
| 4,340,893 | 7/1982 | Ort . | |
| 4,401,990 | 8/1983 | Aiba et al. . | |
| 4,411,705 | 10/1983 | Wallace et al. . | |
| 4,417,259 | 11/1983 | Maeda | 347/31 |
| 4,628,331 | 12/1986 | Ishikawa . | |
| 4,668,959 | 5/1987 | Jochimsen et al. . | |
| 4,861,178 | 8/1989 | Reed . | |
| 5,081,472 | 1/1992 | Fisher . | |
| 5,115,250 | 5/1992 | Harmon et al. . | |
| 5,126,765 | 6/1992 | Nakamura et al. . | |
| 5,202,702 | 4/1993 | Terasawa et al. . | |
| 5,266,974 | 11/1993 | Koitabashi et al. . | |
| 5,557,307 | 9/1996 | Paroff | 347/34 |

FOREIGN PATENT DOCUMENTS

| | | | |
|---|---|---|---|
| A-2697889 | 5/1994 | France . | |
| A-2457643 | 6/1976 | Germany . | |
| A-3817754 | 11/1989 | Germany . | |
| 59-96563 (A) | 6/1983 | Japan . | |
| 362090251 | 4/1987 | Japan | 347/28 |
| 362218139 | 9/1987 | Japan | 347/28 |
| 63-126753 (A) | 5/1988 | Japan . | |
| A-2280149 | 1/1995 | United Kingdom . | |

OTHER PUBLICATIONS

P.A. Quinn, Jr. Disposable Porous Insert for Deflection Plate of Ink Jet Printers. IBM Technical Disclosure Bulletin. Jan., 1980. vol.22 No.8A, p. 3296.

Mitchell et al. Start–Stop Technique for Ink Jet Systems. IBM Technical Disclosure Bulletin. vol. 20 No. 1, pp. 447–448, Jun. 1977.

*Primary Examiner*—N. Le
*Assistant Examiner*—Thien Tran
*Attorney, Agent, or Firm*—Nixon & Vanderhye P.C.

[57] ABSTRACT

A fluid (liquid or water) wash is used to clean the front surface of an ink jet printer cartridge. In addition, a nozzle plate that overlies the nozzle shields the nozzle array from the splatter of ink. In ink jet printers, ink droplets are propelled from an array of orifices in a nozzle plate in the printer head. During the ink droplet ejection, ink is sprayed or deposited around the orifices. The ink droplets are deposited on a paper web adjacent the nozzle and mist from the droplets drifts back to coat the face of the nozzle plate. Some ink seeps behind the nozzle plate onto the array of nozzle orifices. The ink coating attracts particles that tend to clog the nozzle orifices. The ink coating is washed away by fluid streams that flow over the nozzle surface and in some embodiments flow over the nozzle orifices themselves. The fluid may be water, ink or other liquid that is channelled across the nozzle surface, or the fluid may be an air stream that blows across the nozzle surface.

16 Claims, 3 Drawing Sheets

FIG. 5
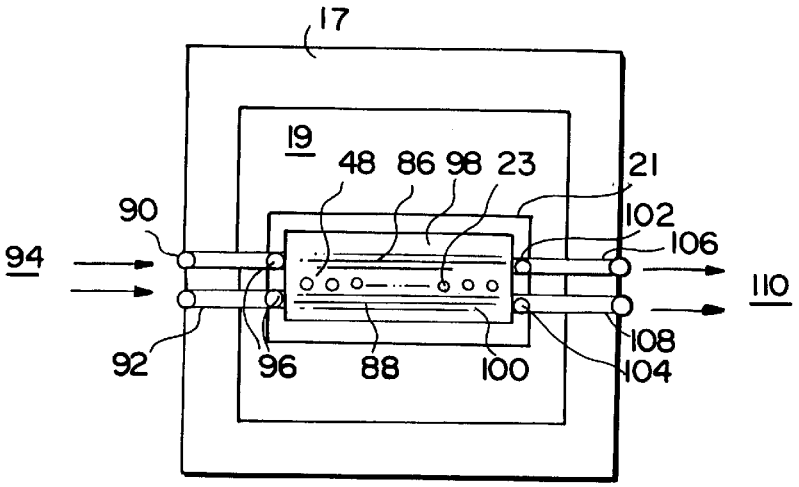
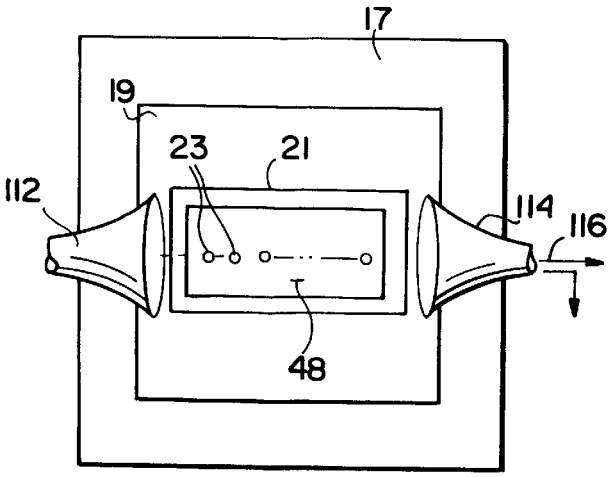
FIG. 6
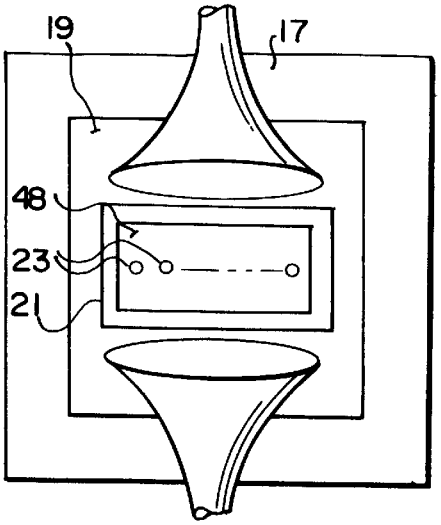
FIG. 7

CLEANING FLUID APPARATUS AND METHOD FOR CONTINUOUS PRINTING INK-JET NOZZLE

FIELD OF THE INVENTION

The invention relates to the fields of print nozzles and, in particular, drop-on-demand printer nozzles, such as ink jet and bubble jet printer nozzles. The invention has particular application to the problems associated with dust, other particles and ink that disrupt and clog these printing nozzles during continuous operation.

BACKGROUND AND SUMMARY OF THE INVENTION

Drop-on-demand ink-jet and bubble-jet printers (collectively referred to as ink jet printers) propel fine ink droplets from nozzles onto a paper substrate adjacent the nozzle. Examples of these types of printers are the Cannon nozzles known as BCO1 and BCO2. By precisely controlling the trajectory and the time of ejection of the ink droplets, the ink jet nozzles print clear dots on paper. To achieve precise positioning of droplets of ink, ink jet nozzles must provide clear and clean orifices for the droplets to pass through as they fly from the nozzle to the surface of the paper. In a conventional drop-on-demand ink jet nozzle, there is an array of several orifices on the face of the nozzle from which the ink droplets are propelled. During printing, ink is ejected out of selected orifices in the array to form the desired images on the paper. The flight of the ink droplets and especially their impact on the paper surface creates a fine mist of ink that coats the surface of the nozzle. Also, during the ejection of the droplets, extraneous ink is sprayed and deposited on the nozzle face adjacent the orifices. This moist ink coating attracts paper fiber, dust, grit and other types of particles that can obstruct the nozzle orifices and block the ink droplets being sprayed from the nozzle. Also, the extraneous ink can build up such that it blocks the orifices. Accordingly, there is a need to regularly clean the nozzle plate of ink jet printers so that the array of orifices remains clear of ink and particles that would otherwise interfere with the printing of ink on the paper.

In the past, ink jet printers have been cleaned by wiper mechanisms that clean the nozzle plates and orifices. Between print jobs, the printer head moves away from the paper web to a cleaning station where is slides against a cleaning wiper. These wipers squeegee across the face of the nozzle plate and the openings of the orifices to remove particles that may be obstructing ink in the nozzles. Because the wipers themselves temporarily obstruct the nozzles, the wipers are used only when the ink jet printer is not printing. For example, a wiper may be positioned at the far edges of a carriage path, beyond the edges of the paper held adjacent the carriage path. An example of a wiping system is disclosed in U.S. Pat. No. 5,126,765, entitled "Ink Jet Recording Apparatus Having Cleaning Means For Cleaning A Recording Head".

Wipers have proven generally acceptable for desk top printing applications where each individual print job is relatively short and the times between when the print nozzles are wiped clean are relatively brief. In a typical desk-top ink-jet printer the carriage with the ink jet printing head can be shifted to a cleaning station after each print operation. Thus, in the usual desk top application, the printing nozzles are cleaned frequently by conventional wipers and tend not to clog with particles.

With continuous web-feed printing, the print nozzle is required to constantly print for many hours. This is unlike typical desk-top printing applications in which each printing operation is conducted in a relatively short period of time. Shifting the print head to a cleaning station away from the paper to be printed necessarily interrupts the printing operation of a continuous printer. While these interruptions do not substantially interfere with typical desk top print jobs, they do interfere with commercial printing of continuous webs. In this regard, conventional ink jet print heads have been found to require cleaning for every 30 to 60 minutes of continuous printing. Remote cleaning stations for ink jet printers are undesirable for commercial continuous printers because the print operation must be interrupted every one-half hour to one hour to clean the nozzles. Accordingly, there is a long-felt need for an apparatus and method for cleaning an ink jet nozzle without interrupting a print job.

Other prior art techniques for cleaning the nozzle face of an ink printer are to blow air at or around the ink nozzles to blow particles off the nozzle face or prevent particles from adhering to the nozzle face. Some of these techniques have included using ionized air to neutralize the static charges on dust particles that attract the dust to the nozzles. These techniques have achieved only partial success as is reported in U.S. Pat. No. 4,411,706, entitled "Method And Apparatus For Eliminating Dust From Ink Jet Printers." While blowing air at the nozzles can be accomplished as the nozzles are spraying ink, the turbulent air flow caused by the prior art blowers disrupts the trajectory of the ink droplets to the paper. Given that the prior systems for cleaning ink jet nozzles have been less than satisfactory, there has been a long felt-need for a technique for effectively cleaning the nozzles. That need was not fully satisfied until the current invention.

The current invention relates to a technique for cleaning an ink jet nozzle with a fluid, such as water or air, that flows across the face of the printing nozzle and entrains the dust and paper particles that adhere to the face of the nozzle. Once caught in the fluid, the particles are removed from the nozzles by the flow of the fluid.

In one embodiment of the invention a fluid stream flows across the face of the nozzle of an ink jet printer to clean the printer. This stream is located proximate to the nozzle array from which the ink droplets are propelled. Oust and paper particles that would otherwise clog the nozzle array are entrained in the fluid stream before they obstruct the orifices of the nozzle. A fluid source, drain supply fluid and network of fluid channels on the nozzle create a fluid stream path adapted to remove the particles and dust in the vicinity of the nozzle array. By continuously flowing fluid across the nozzle face, ink, grit and paper particles are continuously captured and removed from the nozzle array. In some embodiments, the fluid stream does not disrupt the projection of ink droplets from the nozzle array and, thus, does not interfere with printing.

In a first embodiment of the invention, the cleaning fluid is confined to channels adjacent the nozzle orifices. The orifices are not flushed with fluid. Accordingly, the ink jet nozzle can print while the cleaning fluid is flowing because the fluid flow does not obstruct or interfere with the ink droplets ejected from the nozzles to the paper. Accordingly, the first embodiment of the current invention provides a technique and apparatus for continually removing particles from an ink jet printer face while printing continues.

In a second embodiment of the invention, cleaning fluid flows directly over the print nozzle orifices to wash the orifices and nozzle in general. Printing is interrupted while the orifices are washed using the second embodiment. This orifice wash embodiment of the invention flushes out any ink residue, dust or paper fibers clogging the orifices. Thus, the second embodiment provides a more thorough cleaning of the print nozzle than does the first embodiment. The second embodiment of the invention may be used in conjunction with the first embodiment.

In a third embodiment of the invention, the array of nozzle orifices is shielded from ink spray and splatter by a nozzle plate. The nozzle plate is positioned in front of the orifices and includes a narrow slit through which ink droplets fly. The nozzle plate is separated by a small gap from the array of nozzle orifices and excess ink drains through this gap away from the nozzle orifices. This third embodiment may be used in conjunction with the first and second embodiments of the invention.

An object of the current invention is to clean the nozzle array of an ink jet printer and prevent ink, dirt and paper particles from obstructing the orifices of the nozzle array. It is a further object of the invention to continually capture and remove ink and particles from the nozzle array while the nozzles are printing and to wash the nozzles completely at other times. A further object of the invention is to extend the period of maintenance free printing for ink jet printers and to reduce the frequency of off-print cleaning occurrences required for ink jet printers. Moreover, another objective of the invention is to enhance the print quality of ink jet printers by overcoming many of the problems caused by extraneous, girt and paper particles that have clogged prior ink jet printers. These and other objectives are achieved by the invention that is shown and described in detail below.

BRIEF DESCRIPTION OF THE DRAWINGS

The invention will be explained in greater detail with reference to the drawings identified as follows:

FIG. 5 shows a front view of a further embodiment of the invention, and

FIGS. 6 and 7 show a front view of yet another embodiment of the invention.

DETAILED DESCRIPTION OF THE PREFERRED EMBODIMENT

Figure 1:
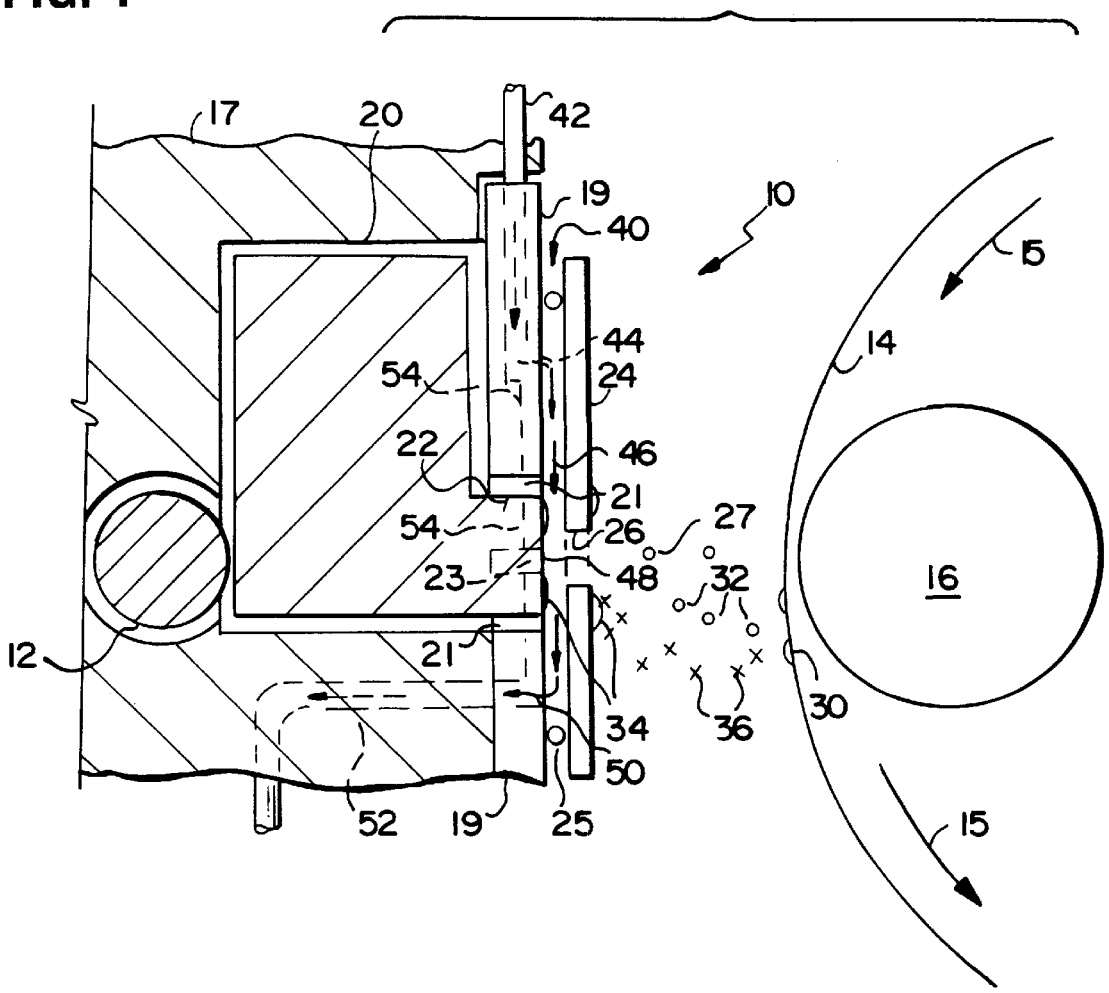
FIG. 1 is a cross-sectional view of an ink jet printer head with an associated fluid cleaning mechanisms, forming a first embodiment of the invention.

FIG. 1 shows an ink jet printer head 10 mounted as a carriage on a shaft 12 in a printing mechanism. In particular, the printing mechanism may be an otherwise conventional continuous web-feed printer, for high volume computer printing. It is common for the web speed in such printers to be 300 feet per minute and have an operating speed range of 200 to 500 web-feet per minute. In addition, these printers operate continuously and will typically print for periods as long as twelve hours without interruption, provided that the ink jet printer does not require cleaning in that period.

The paper or other web substrate moves as a web 14 in the direction of arrow 15. The web moves across the surface of a platen 16 adjacent the printer head. The platen positions the web for printing directly in front of and generally parallel to the ink jet printer head. The printing mechanism may include conventional web handling devices (not shown), e.g., tractor feeders, to move the web at a predetermined speed, in a precisely controlled fashion and along a predetermined path. The ink jet printer head is attached to the shaft by a bracket 17 such that the printer head may be fixed in position on the shaft and arranged in an array with other printer heads uniformly spaced across the width of the web. Alternatively, the printer head may be slidably mounted on the shaft, and moved back and forth across the shaft in a controlled fashion during printing, to position the printer head with respect to the moving web. The bracket may also includes fins 18 that dissipate heat away from the ink jet printer head. A thermocouple may be attached to the root of a heat fin to sense the temperature of the printer head. The bracket may be formed of aluminum or any other material that is suitable for securely holding the ink jet nozzle assembly.

The ink jet nozzle assembly includes a mounting plate 19 on the front face of the print head bracket 17. The mounting plate holds the print head in a recess 20 of the bracket. The plate overlaps the bracket recess and is removably attached to the bracket by screws or other fastening devices. The mounting plate includes a rectangular slot 21 through which protrudes the front nose 22 of the printer head. The array of nozzle orifices 23 are located on the front surface of the nose of the print head. The mounting plate may be made of machined copper and coated with a hydrophilic coating, e.g. Teflon, at and near the area of the orifices 22 to reduce the tendency of excess ink to clog the orifices.

A nozzle plate 24 overlaps the mounting plate and he nose of the print head. The nozzle plate is attached to the mounting plate or bracket by screws or other fastening device. A seal 25 may be located between the nozzle plate and mounting plate prevents cleaning fluid from leaking out from the gap between the two plates. In addition, the nozzle plate includes a narrow slit 26 aligned with the array of orifice nozzles 23 in the print head to allow ink droplets to fly from the orifices, through the slit 26 and towards the paper web 14. The slit is in alignment with the array of orifice nozzles. In addition, the slit has an opening area that is just slightly larger than the area of the nozzle array. The nozzle plate partially shields the nozzle array from the splash of ink hitting the paper web. The nozzle plate may be formed of a porus material so that ink splattered onto the nozzle plate can be drawn through the plate and into the gap between the back of the nozzle plate and the mounting plate.

The nozzle plate shields the printer head from the splatter of ink droplets as they impact on the paper web. Ink spray collects on the outer face of the nozzle plate instead of splashing back onto the nozzle array. In addition, ink that does seep into the gap 40 between the mounting and nozzle plate is shielded from paper and web fibers and other particles that tend to be attracted to surfaces wetted with ink. The ink that does collect on the nozzle surface 48 of the printer head does not collect web fibers and other particles because of the nozzle plate. It is believed that the presence of the nozzle plate alone can extend to several hours (opposed to 0.5 to 1.5 hours) the period of time during which a print head nozzle can reliably and continuously print between cleanings.

Ink droplets 27 are propelled from the nozzle orifices 23 in a direction towards the paper web 14 for printing. As the ink droplets impact on the web, most of the ink remains on the web as dots 30, or other indicia. Some of the ink will splatter as it hits the paper and form a mist of ink particles 32. In addition, there will be some residue of ink mist resulting from the ejection of the ink droplets from the nozzle orifices. This ink mist floats in the vicinity of the nozzle plate, print head nose 22 and paper web, and tends to settle on these surfaces, as an ink coating 34 that builds in thickness as ink printing continues. Since the paper web is moving, there is no noticeable build-up on any one section of the web. The print head does not move. Accordingly, the ink build up on the print head surfaces can pose problems, that are solved by the current invention.

The impact of the ink droplets, movement of the paper web and other factors cause paper fibers and other fine particles 36 to dislodge from the web and other surfaces and float in the ink mist. In addition to the build-up of ink around the nozzle caused by the misting of the ink, some of these particles contribute to the build-up 34 of ink and particles in the vicinity of the ink-jet nozzles. If this build-up is permitted to continue without being removed by cleaning, the build-up will clog the nozzle orifices 23 and disrupt printing of the ink. While the nozzle plate shields the print head from much of the ink spray and stray particles, the nozzle plate does not entirely avoid the need to wipe clean the array of nozzle orifices. The current invention also includes a technique for removing ink and particle build-up surrounding the nozzle orifices while printing continues.

It has been found that by flushing a fluid, such as water or air, across the face of the nose 22 of the print head, that the ink and particles coating the nozzle array can be washed away. In one embodiment, water is supplied to the gap 40 between the mounting plate 19 and nozzle plate 24 from a water source via conduit 42 that passes through the bracket 17 and mounting plate and discharges from an relatively wide opening(s) 44 on the front surface of the mounting plate. Fluid discharged from these openings enters the gap 40 between the mounting and nozzle plates and flows downwardly, as indicated by arrow 46, between those plates and towards the nose 22 of the print head. As the fluid reaches the print head nose 22, it wets and flows over the front surface 48 of that nose. In doing so, ink, web fibers and particles coating the front surface of the nose are washed away with the fluid.

The fluid with the ink, fibers and other particles flows downward through the gap between the mounting and nozzle plates until reaching a suction opening 50 in the mounting plate. Due to a slight suction applied at that opening, the fluid is drawn into the opening and away through conduits 52 to a discharge (not shown). The fluid, if water or other liquid, may be disposed of or filtered and recycled through the printer. Alternatively, the fluid drawn by suction into the suction opening 50 may be just the excess ink in the gap 40 between the mounting and nozzle plates. The suction of fluid will create capillary forces in the gap that draw the ink downward through the gap to the suction opening and away from the nozzle array. In this alternative embodiment, a separate source of fluid, supply conduits 42 and fluid discharge openings 44 above the printer head are unnecessary, because the excess ink is itself used as the cleaning fluid.

If a washing fluid, such as distilled water, is supplied, then printing may have to be interrupted or may continue while the fluid washes the front surface 48 of the nozzle, depending on the flow path of fluid across the face of the nozzle array. If the flow of fluid is heavy across the entire nozzle array, then the fluid will wash across the orifices 23. While such a heavy flow is particularly effective at cleaning clogged print orifices, the fluid would interfere with the projection of ink droplets and, thus, printing may be interrupted or even stopped for heavy flows of cleaning fluid. Alternatively, a lighter flow of fluid confined to channels 54 on the mounting plate and/or front surface 48 of the nozzle may be used while printing continues because the channels do not cut across any of the print orifices thereby interfering with the ink flow. Excess ink, fibers and other particles can be attracted to these channels by coating the channels and surfaces near the channels with hydrophilic coatings. The fluid in the channels carries the ink, fibers and other particles away from the front surface of the nozzle array and to the suction opening 50.

Figure 2:
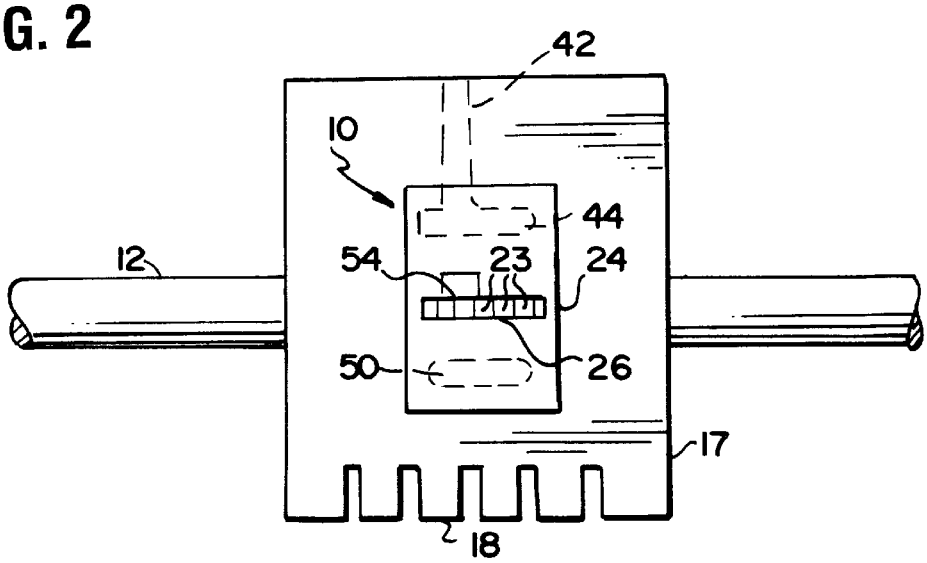
FIG. 2 is a front view of the face of the ink jet printer head shown in FIG. 1, and FIGS. 3 and 4 show cross-sectional and front views, respectfully, of another embodiment of the invention.
Figure 3:
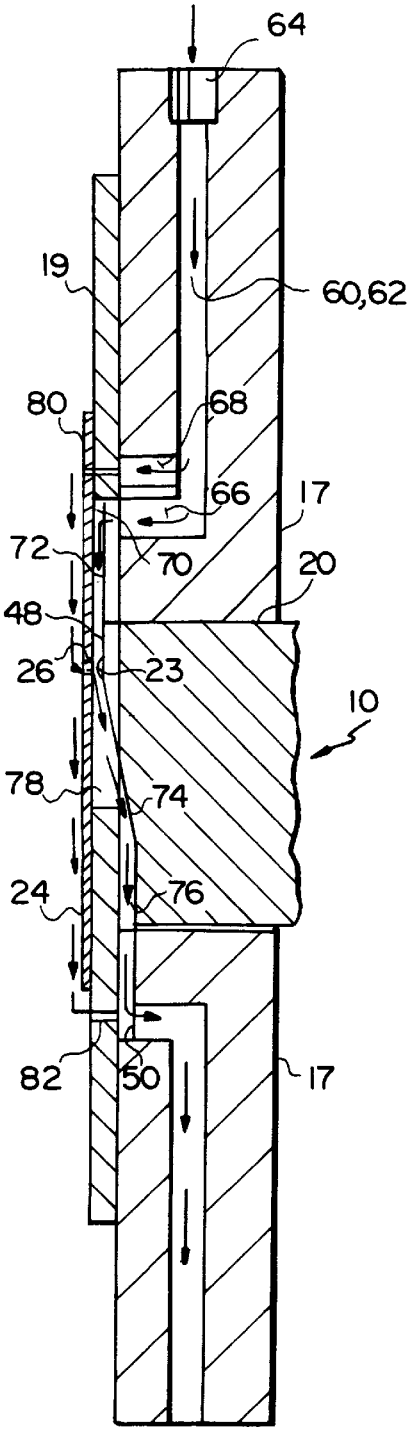
Figure 4:
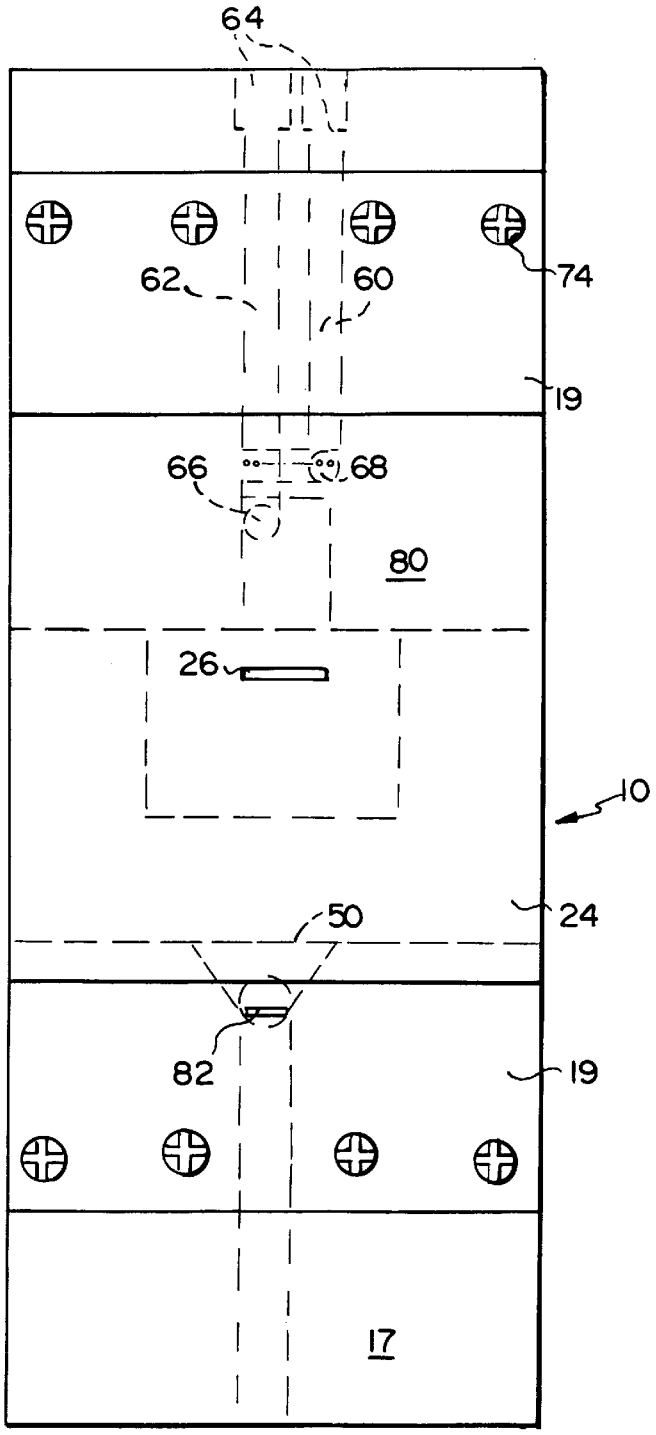

In another alternative embodiment, such as shown in FIGS. 3 and 4, (the same numerals from FIGS. 1 and 2 have been used in these figures to refer to features that are common to all figures), the single fluid path of the first embodiment has been changed to a dual-path fluid system for cleaning away excess ink, paper fibers and other particles. This dual-path fluid wash is intended for use while the print head is not printing, as the wash might interfere with the printing operation. A pair of fluid conduits 60, 62 extend through a top portion of the print head bracket 17 from a pair of outlets 64 to a fluid source (not shown) to first and second fluid discharge ports, 66, 68, respectively. In this embodiment, the nozzle plate is attached directly to the mounting plate by means of screws 74 or other attachment means.

The first discharge port 66 opens from the bracket 17 out to a gap 70 between the nozzle plate 24 and a front surface section 72 of the bracket and print head, which section includes the front surface of the nozzle 48. Fluid flows downwardly through this gap until it passes over the orifices 23 of the nozzle array. Below the nozzle array, the front surface of the print head drops back along an inclined section 74 until it meets with another vertical section 76 that ends at the suction opening 50 for the bracket. The inclined surface widens the gap 70 into a relatively-large reservoir 78 which collects the fluid, excess ink, web fibers and other accumulated particles. Fluid flows downwardly into the reservoir and is drawn by capillary forces into the suction opening 50 of the bracket.

Similarly, the second fluid conduit 68 carries fluid to the second discharge port 68, that may constitute a row of openings as shown in FIG. 4, through which the fluid exits to the surface 80 of the nozzle plate 19. The fluid wets and washes the front surface of the nozzle plate as the fluid flows down and across the surface of the plate. At the slit 26 in nozzle plate 24, portions of the fluid may flow around, over and into the slit. The fluid that flows around and over the slit, washes away ink and particles that have collected on the plate. This outer path fluid, ink and particle mixture continues its downward flow over the nozzle plate (surface tension holds the fluid stream onto the plate surface) until the fluid is drawn into an opening 82 in the nozzle plate in communication with the suction opening 50 of the bracket. Fluid that is drawn into the slit 26, washes the slit and is drawn into the cavity 78 between the nozzle plate and printer head, from where the fluid, ink and particle mixture is drawn in by the suction opening 50 of the bracket.

FIG. 5 shows another embodiment of the invention in which a pair of fluid streams 86, 88 flow across the nozzle front surface 48 on either side of the nozzle array 23 to clean ink from the surface 48 while printing is ongoing. This embodiment may be employed with or without (as shown) a nozzle plate. A pair of horizontal fluid conduits 90, 92 mounted on or within the mounting plate 19 are connected to a fluid source (represented by arrows 94) and discharge from openings 96 adjacent the front surface 48 of the print head nozzle. Fluid from the discharge openings enter a pair of horizontal channels 98, 100 that are parallel and on opposite sides of the nozzle array 23. The channels and surfaces proximate the channels and nozzle orifices may be coated with a hydrophobic material so that ink will not be allowed to accumulate in these areas and is drawn into the channels and washed away by the channel flow. As the fluid in the channel reaches the opposite end of the channel, the fluid is drawn by suction into openings 102, 104 on the mounting plate. These openings are connected to conduits 106, 108 that are also connected to a drain 110 that imparts suction to the conduits and openings 102, 104 to draw the fluid through the channels.

FIGS. 6 and 7 show another embodiment of the invention especially adapted to using air (or other gas) as a cleaning fluid. An air bellows manifold 112, such as a oval shaped funnel, provides a low-pressure air flow directed horizontally (FIG. 6) or vertically (FIG. 7) across the front surface 48 of the nozzle array 23. The bellows manifold is connected to a source of compressed air (not shown). The air flow pressure blows on the ink wetted to the front surface of the nozzle array and causes the ink (including entrained fibers and other particles) to flow away from the bellows 112 and towards a vacuum manifold 114, that may have a shape similar to that of the bellows. The vacuum manifold collects the ink flow and directs (see arrow 116) towards a drain (not shown). In addition, the vacuum manifold may be connected to a vacuum pump to draw air across the nozzle array and into the manifold. Depending on whether the pressure of the air flow across the nozzle array disrupts the trajectory of the ink jet nozzles, the bellows and vacuum manifolds may or may not be operated while printing is ongoing.

The invention has been described in what is considered to be the most practical and preferred embodiments. The invention is not limited to the disclosed embodiments, but covers various modifications and equivalent arrangements included within the spirit and scope of the appended claims.

What is claimed is:

1. An ink jet printer head comprising:

a. an array of nozzle orifices through which ink droplets are projected in a path towards a substrate for printing and a front surface of said array of nozzle orifices having channels passing between the orifices;

b. a nozzle plate disposed between said array of nozzle orifices and the substrate and separated by a gap from the array, said nozzle plate having a slit aligned with respect to the path to allow the ink droplets to fly through the slit, and c. a liquid cleaning fluid stream flowing in the channels of the front surface, and through the gap between the nozzle plate and array of nozzle orifices, wherein said liquid fluid stream flows while ink droplets are being projected from the nozzle orifices during printing.

2. An ink jet printer head as in claim 1 wherein the slit in the nozzle plate has an area that is slightly larger than an area of said array of nozzle orifices.

3. An ink jet printer head as in claim 1 wherein said nozzle plate is formed of an ink adsorbent, porous material.

4. An ink jet printer comprising:

a. an ink jet printer head having a front surface and an array of nozzle orifices arranged on the front surface, wherein ink droplets are projected through the orifices along a path towards a substrate;

b. a bracket having a recess adapted to receive the ink jet printer head;

c. a mounting plate removably attached to said bracket and securing said ink jet printer head in the recess, said mounting plate having an opening into which projects the front surface of the ink jet printer heads;

d. a nozzle plate attached to said mounting plate and covering the opening in the mounting plate and separated by a gap from the front surface the ink jet printer head, wherein said nozzle plate having a slit aligned with the array of nozzle orifices and through which pass ink jet droplets on their path, and e. a liquid cleaning fluid stream flowing in the gap between the nozzle plate and front surface of the printer head, wherein said liquid fluid stream flows adjacent to the nozzle orifices while ink droplets are projected from the nozzle orifices to the substrate.

5. An ink jet printer head as in claim 4 further comprising a cleaning fluid stream flowing across the front surface of the ink jet printer head.

6. An ink jet printer head as in claim 4 wherein said nozzle plate has a front surface facing the substrate and a rear surface facing the printer head, and said nozzle plate is porous such that ink splattered on the front surface is drawn through the nozzle plate and washed away by the liquid cleaning fluid stream.

7. An ink jet printer as in claim 4 further comprising a second liquid fluid stream on a front surface of the nozzle plate facing the substrate and wherein at least a portion of the second liquid fluid stream is drawn through the slit in the nozzle plate to merge with the liquid cleaning fluid stream.

8. An in jet printer as in claim 4 wherein said front surfaces of said printer head is furrowed with channels for the liquid cleaning fluid stream(s).

9. An ink jet printer as in claim 8 wherein said channels are coated with a hydrophilic material.

10. An ink jet printer as in claim 4 wherein the gap between the front surface of the ink jet printer head and the nozzle plate widens to form a reservoir below the array of nozzle orifices.

11. An ink jet printer as in claim 4 further comprising a suction opening in said bracket and located below the array of nozzle orifices and said suction opening having a slight vacuum for drawing excess ink from the gap between the ink jet printer head and the nozzle plate.

12. An ink jet printer as in claim 4 further comprising a suction opening in said bracket and located below the array of nozzle orifices and said suction opening having a slight vacuum for drawing in the liquid fluid stream after the stream washes across the front surface of the printer head.

13. An ink jet printer as in claim 12 wherein said nozzle plate includes an opening aligned with the suction opening in the bracket and liquid fluid flowing over the nozzle plate is drawn into the opening in the plate and further into the suction opening.

14. A method for cleaning an ink jet printing head having a front surface with a nozzle array of orifices, and a nozzle plate separated by a gap from the front surface of the printing head, the method comprising the following steps:

a. propelling ink from the nozzle array through a slit in the nozzle plate and towards a web for printing on the web;

b. shielding the orifices from ink splatter and airborne fibers and particles with the nozzle plate;

c. washing the front surface of the printing head with a liquid fluid stream while propelling ink during step (a), and d. draining the liquid fluid stream and excess ink on the nozzle array down through the gap between the front surface of the printing head and nozzle plate.

15. A method for cleaning an ink jet printing head as in claim 14 wherein the nozzle plate includes a channel adjacent the orifices and step (c) is further practiced by flowing the liquid fluid stream through the channel in the nozzle plate.

16. A method for cleaning an ink jet printing head as in claim 14 wherein step (c) further includes washing a front surface of the nozzle plate with a liquid fluid stream and drawing a portion of the liquid fluid stream across the nozzle plate through the slit in the nozzle plate.

* * * * *